US007398563B2

(12) United States Patent
Chen

(10) Patent No.: US 7,398,563 B2
(45) Date of Patent: Jul. 15, 2008

(54) TOILET SEAT STRUCTURE THAT CAN BE LIFTED UP THROUGH A PEDAL

(76) Inventor: Yung-Chung Chen, P.O. Box 44 - 2049, Taipei (TW) 10668

( * ) Notice: Subject to any disclaimer, the term of this patent is extended or adjusted under 35 U.S.C. 154(b) by 158 days.

(21) Appl. No.: 11/503,080

(22) Filed: Aug. 14, 2006

(65) Prior Publication Data

US 2008/0034484 A1 Feb. 14, 2008

(51) Int. Cl.
*A47K 13/10* (2006.01)

(52) U.S. Cl. ..... 4/246.1

(58) Field of Classification Search ..... 4/246.1–246.2
See application file for complete search history.

(56) References Cited

U.S. PATENT DOCUMENTS 4,584,724 A * 4/1986 Wilson ..... 4/246.5
5,404,595 A * 4/1995 Carmel ..... 4/246.1
6,393,623 B1 * 5/2002 Strickland, Jr. ..... 4/246.3

* cited by examiner

*Primary Examiner*—Charles E. Phillips

(57) ABSTRACT

A toilet seat structure including a toilet seat, a link, a pedal and a fixing plate can be lifted up through the pedal. The toilet seat is connected to one end of the link. The other end of the link is pivoted on the pedal. A middle of a bottom surface of the pedal is mounted with the fixing plate. Stamping the pedal can raise the other end to move the link and push the toilet seat to rotate upward according to the connection structure. When the pedal is loosened, the toilet seat automatically restores to be horizontally placed on a toilet bowl to make the link and the pedal restore. Thus, the cleanliness and sanitation of the toilet seat can be kept, and the position of the toilet seat can be conveniently changed by the stamping foot.

1 Claim, 7 Drawing Sheets

TOILET SEAT STRUCTURE THAT CAN BE LIFTED UP THROUGH A PEDAL

BACKGROUND OF THE INVENTION (1) Field of the Invention

The invention relates in general to a toilet seat structure, and more particularly to a toilet seat structure capable of being lifted to an upright position stably and automatically restoring to a horizontal position without using a hand to touch the toilet seat so that the convenience, cleanliness, sanitation, and usage effectiveness can be achieved.

(2) Description of the Prior Art

Toilet seats have been widely used in cleanliness sanitation apparatuses at home, wherein males and females share only one toilet seat. Due to the difference in the physiological structures, the following condition may occur. The urine tends to remain on the toilet seat if it is not lifted when the male is urinating. So, the subsequent user has to wipe and clean the seat in order to use the seat in a worriless manner. Thus, it is troublesome and inconvenient to the subsequent user.

So, it is therefore an object of the present inventor to provide a toilet seat structure that can be lifted up through a pedal to facilitate the usage in the society.

SUMMARY OF THE INVENTION

A main object of the invention is to provide a toilet seat structure that can be lifted up through a pedal, which is stamped by a foot to easily control and change a lifted upright position and a restored horizontal position of the toilet seat so that the convenience and the usage effectiveness can be obtained.

Another object of the invention is to provide a toilet seat structure that can be lifted up through a pedal, which may be stamped by a foot of a male who wants to urinate. Thus, a seat does not have to be lifted by a hand and is free from any remained urine so as to meet the requirement of personal cleanliness sanitation and to provide the convenience for the subsequent user.

Still another object of the invention is to provide a toilet seat structure, which can be lifted up through a pedal, and can be mounted on any side of a toilet bowl in a DIY manner. The lifting angle and distance of the toilet seat can be adjusted and controlled according to the actual size of the toilet bowl.

To achieve the above-identified objects, the invention provides a toilet seat structure including a toilet seat, a pedal, an L-shaped link and a fixing plate. The toilet seat has opposite T-shaped ribs formed on a backside of the toilet seat and near fixing ends of the toilet seat, holes formed on the backside of the toilet seat, and opposite elastic soft pads disposed on the backside away from the fixing ends to buffer the falling toilet seat. The pedal is integrally formed with a plane and two arced plates extending downward from two sides of the plane of the pedal. Horizontally arranged connecting holes are respectively formed at middle portions of the two arced plates. The L-shaped link has a short rod portion and a long rod portion. The short rod portion may pass through a hole of the T-shaped rib for connecting and positioning and may be properly rotated. The long rod portion is formed with one through hole or through holes, which may correspond to different toilet bowls with different heights for the adjustment of a lifting angle and a lifting distance of the toilet seat, near an end of the long rod portion. The long rod portion may be swingably and selectively pivoted on an elliptic through hole on an end surface of the pedal. A pin passes through the elliptic through hole and the through hole of the long rod portion for positioning. The fixing plate has a plane and two side plates extending upward from two sides of the plane of the fixing plate. The plane of the fixing plate is formed with a positioning hole through which a screw passes to fix and position the fixing plate to a ground. Vertically arranged fixing holes are formed on each of the two side plates, so that a positioning pin may pass through the corresponding one of each of the vertically arranged fixing holes and the corresponding one of each of the horizontal arranged connecting holes of the arced plates. Consequently, the pedal may swing about the fixing plate to move the link to control the lifting angle and the lifting distance of the toilet seat.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
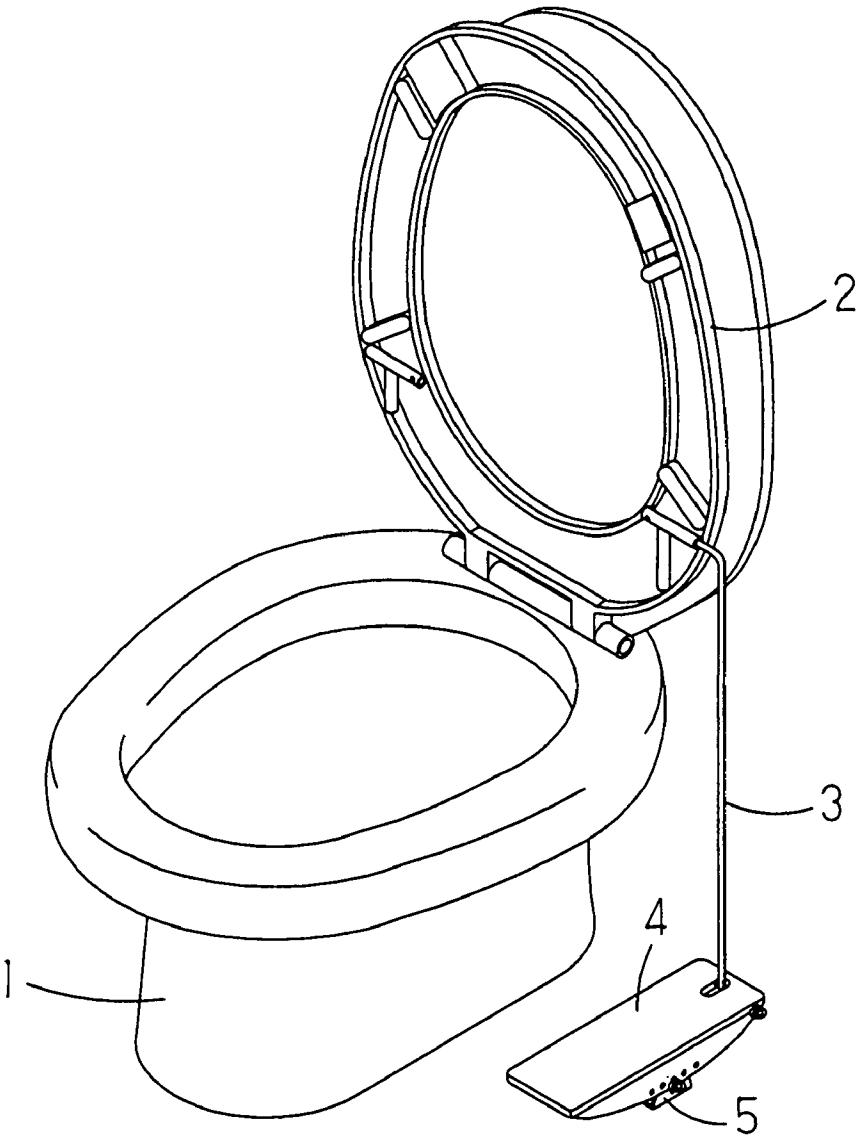
FIG. 1 shows an implemented state of a preferred embodiment of the invention.

As shown in FIG. 1, a toilet bowl (1) is combined with a toilet seat structure of the invention. The toilet seat structure includes a toilet seat (2), an L-shaped link (3) connected to the toilet seat at one end, a pedal (4) connected to the other end of the link (3), and a fixing plate (5) mounted on a bottom surface of the pedal (4).

Figure 2:
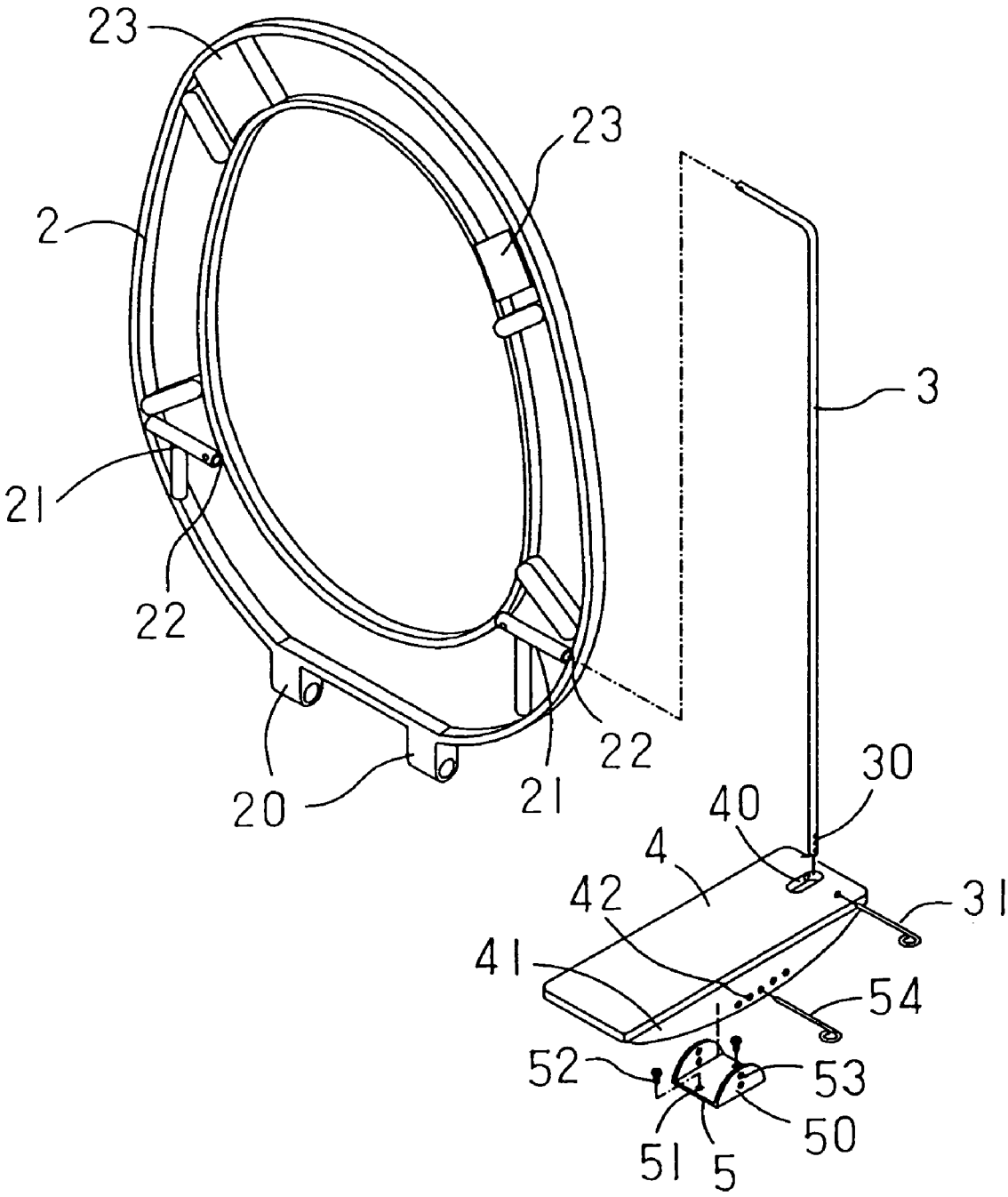
FIG. 2 is an exploded view showing the preferred embodiment of the invention.

As shown in FIG. 2, the component units and the assembled relationship therebetween in the toilet seat structure will be described. Two opposite T-shaped ribs (21) and holes (22) are formed on two sides of a backside of the toilet seat (2) near fixing ends (20). Two opposite elastic soft pads (23) are properly disposed on the toilet seat (2) away from the fixing ends (20) to buffer the toilet seat (2), which is placed down. The L-shaped link (3) has a short rod portion, which may pass through the T-shaped rib (21) to provide the functions of combining and positioning and may be properly rotated, and a long rod portion, which is formed with one through hole (30) or through holes (30) near an end thereof. The long rod portion may be swingably and selectively pivoted on an elliptic through hole (40) formed on an end surface of the pedal (4). A pin (31) passes through the elliptic through hole (40) and the through hole (30) in order to response with different heights of different toilet bowls (1). The pedal (4) is integrally formed with a plane and two arced plates (41) downwardly extending from two sides thereof. The two arced plates (41) are formed with horizontally arranged connecting holes (42) at middle portions thereof so that the lifting angle and distance of the toilet seat (2) can be adjusted. The fixing plate (5) includes a plane and two side plates (50) extending upward from two sides thereof. The plane of the fixing plate (5) is formed with positioning holes (51), through which screws (52) pass, such that the fixing plate (5) may be surely positioned on the ground. Vertically arranged fixing holes (53) are formed on the two side plates (50). One pin (54) may pass through one of the fixing holes (53) and the corresponding one of the horizontally arranged connecting holes (42) on the arced plates (41) for positioning so that the pedal (4) may swing about the fixing plate (5) and thus move the link (3).

Figure 3:
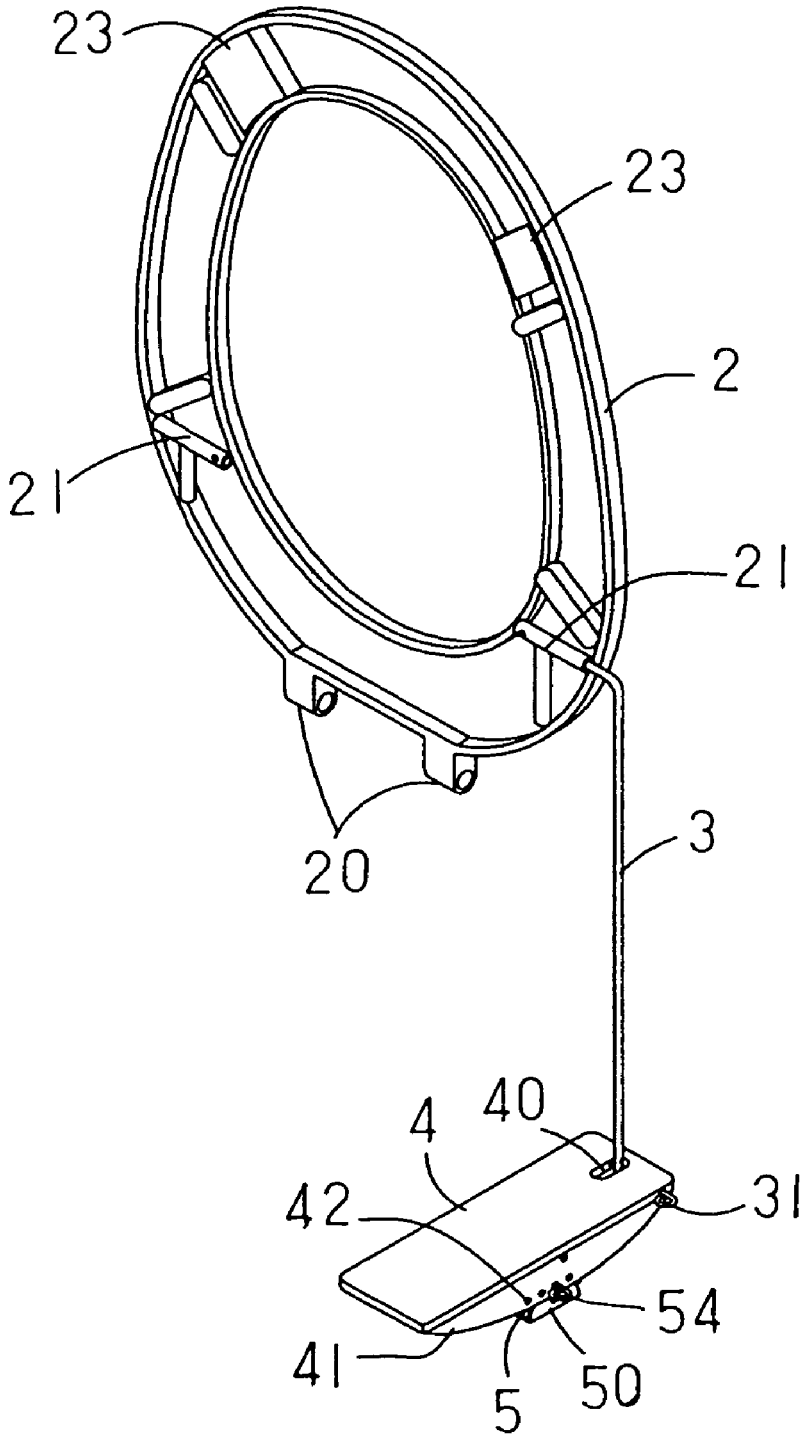
FIG. 3 is an assembled view showing the preferred embodiment of the invention in one direction.
Figure 4:
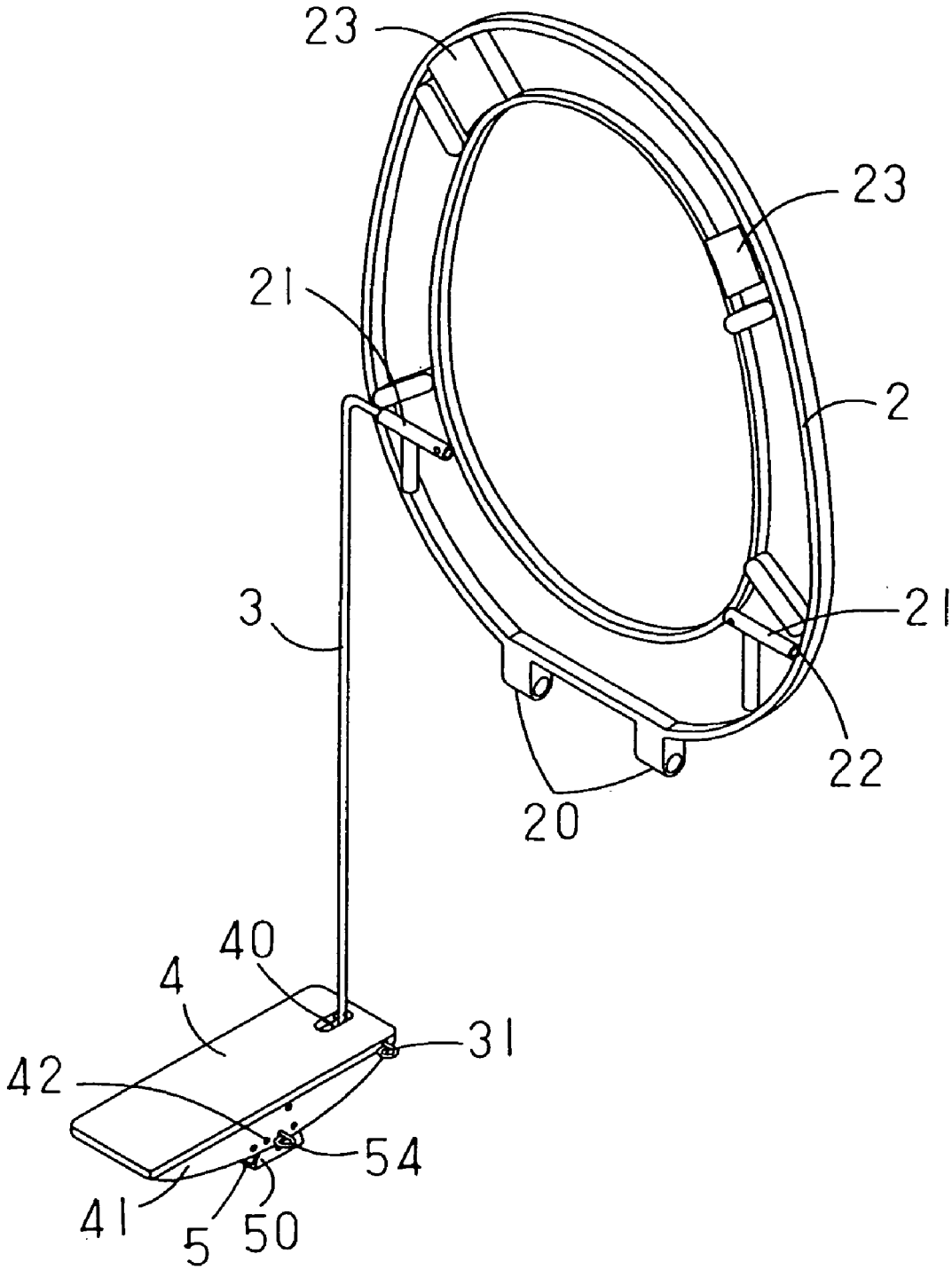
FIG. 4 is an assembled view showing the preferred embodiment of the invention in another direction.

As shown in FIGS. 3 and 4, the toilet seat structure of the invention has no orientation limitation. That is, the toilet seat structure may be freely disposed on any side of the toilet bowl (1). Because the space left in advance is not always located at the same side of the toilet bowl, the user has to make a selection according to the actual environment condition in the DIY processes. This is also one of the conveniences provided in this invention.

Figure 5:
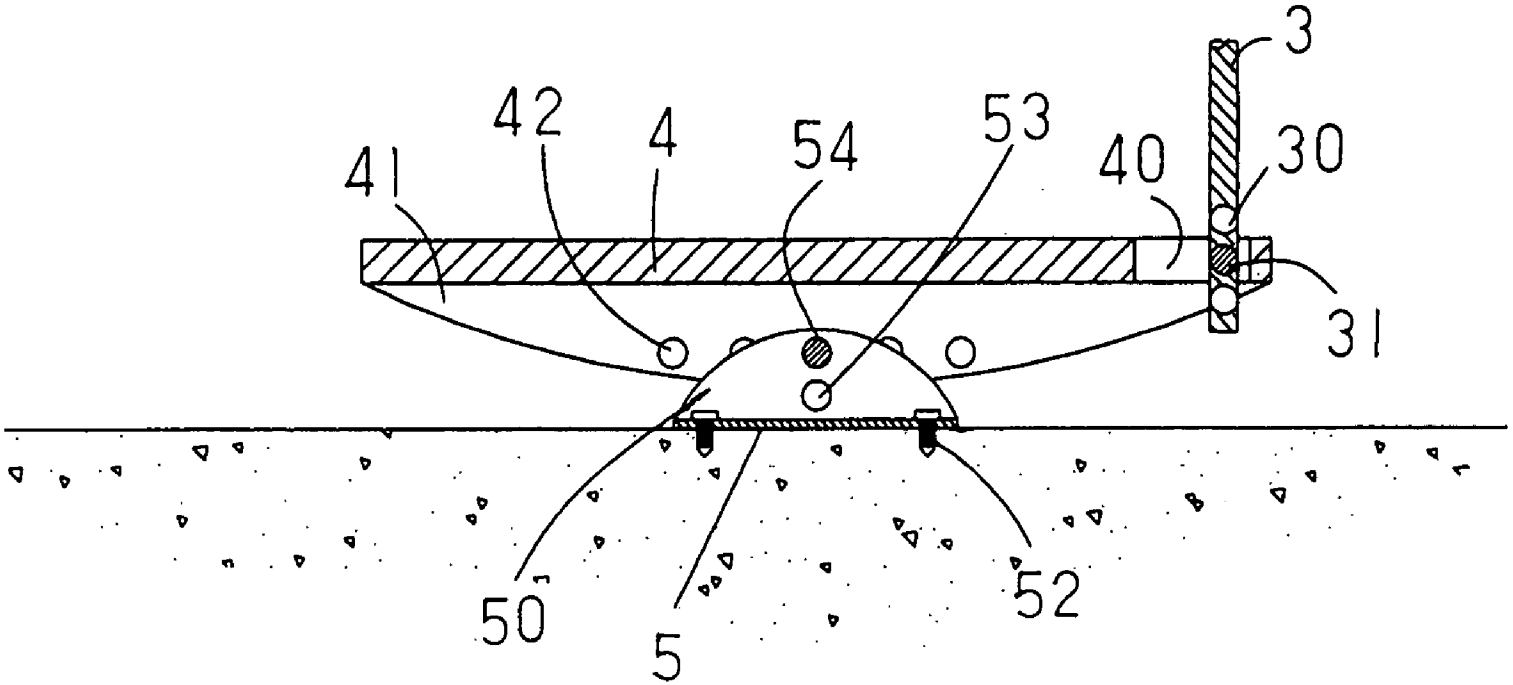
FIG. 5 is a schematic illustration showing an assembled state according to the preferred embodiment of the invention.

As shown in FIG. 5, after the position is selected, the fixing plate (5) is fixed to the ground using the screws (52). Then, the height of the toilet bowl (1) is inspected, and the pin (54) passes through a selected pair of connecting holes (42) of the pedal (4) and the pair of fixing holes (53) of the fixing plate (5) such that the pedal (4) and the fixing plate (5) are combined together and can swing relative to each other.

Figure 6:
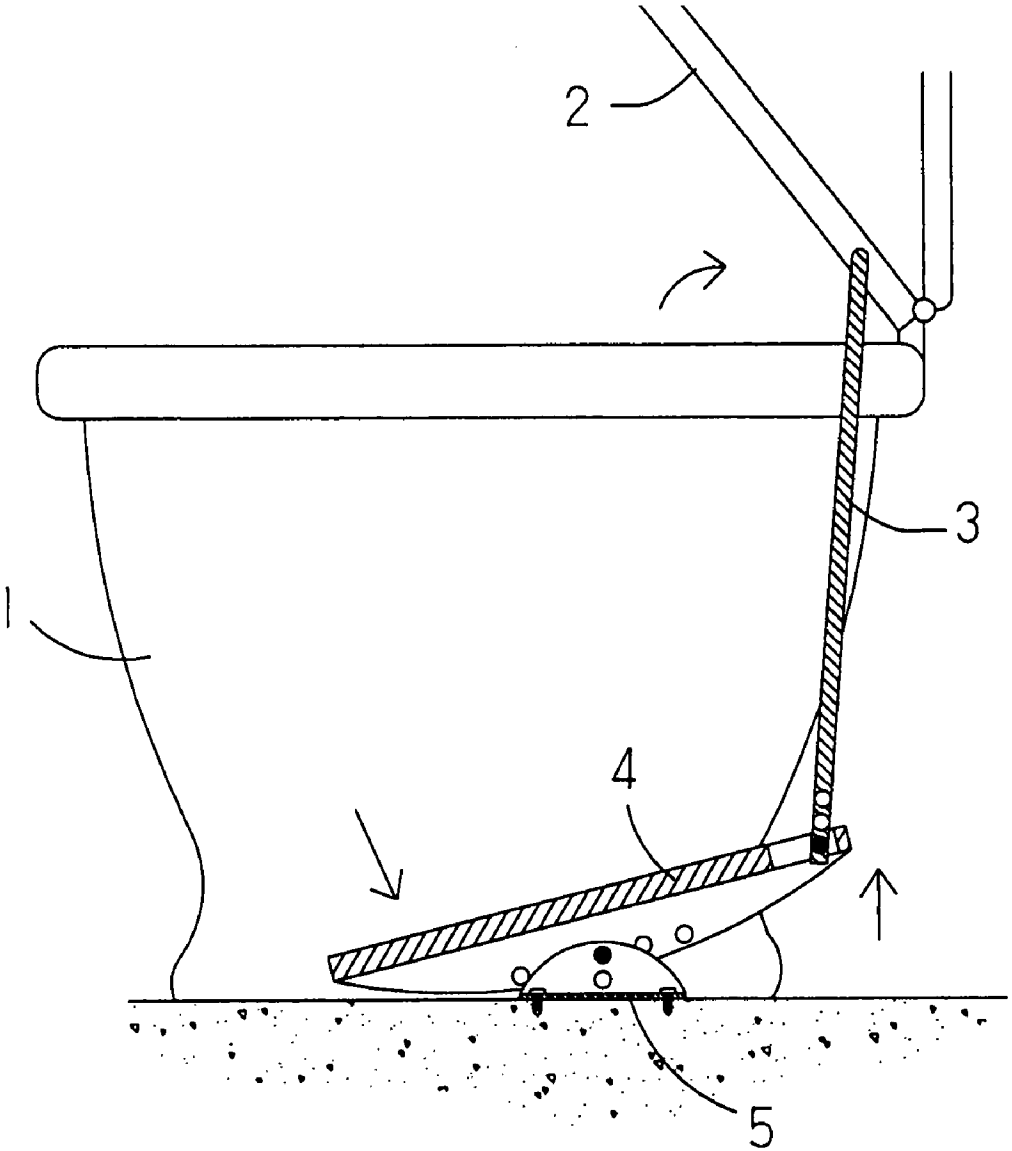
FIG. 6 is a schematic illustration showing a lifting operation of a toilet seat according to the preferred embodiment of the invention.
Figure 7:
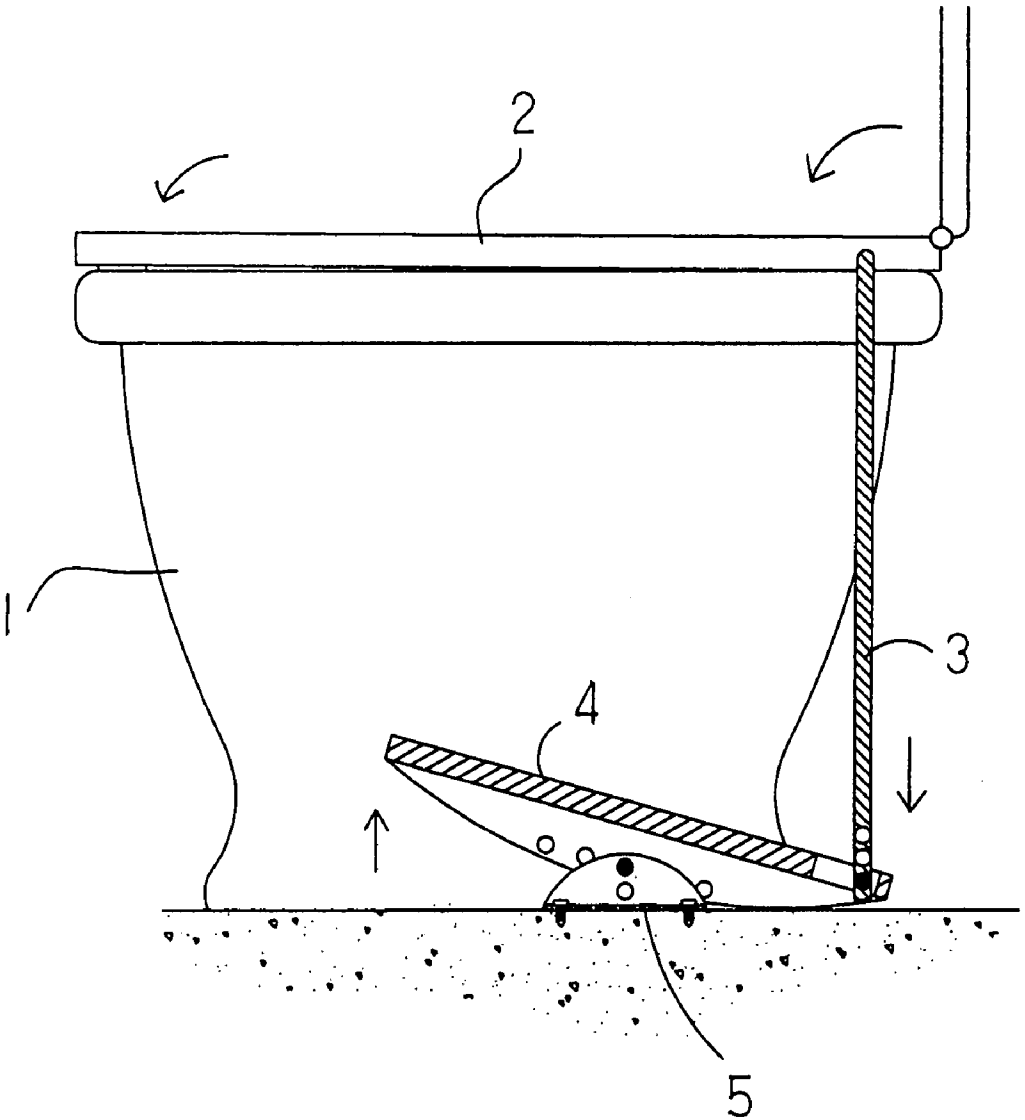
FIG. 7 is a schematic illustration showing that the toilet seat returns to a horizontal state according to the preferred embodiment of the invention.

As shown in FIG. 6, when a free end of the pedal (4) is stamped by a foot in the actual operation of the embodiment, the opposite end of the pedal (4) is lifted to push the link (3) upward and simultaneously upheave the toilet seat (2) to rotate backward to a suitable lifting angle and distance. In this case, the male user can urinate conveniently. As shown in FIG. 7, after the urinate, he only has to remove his foot from the pedal (4), and the toilet seat (2) naturally falls down when no force is applied thereto, so as to restore to the state where the toilet seat (2) is horizontally placed on the toilet bowl (1) automatically. Thus, a subsequent female user may conveniently use this toilet seat (2).

Because the toilet seat structure has to match with various toilet bowls (1) having different heights and dimensions, many sets of connecting holes (42) and through holes (30) are formed on the connecting structure between the pedal (4) and the fixing plate (5) and between the pedal (4) and the link (3). Thus, when the user is installing the toilet seat (2), he or she can made a suitable selection according to the actual height of the toilet bowl (1).

According to the above-mentioned embodiment, the invention can indeed achieve the desired object and effect. In addition, compared with the prior art, the personal cleanliness and sanitation effect can be satisfied and the toilet seat may be used more conveniently.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A toilet seat structure, comprising:

a toilet seat having opposite T-shaped ribs formed on a backside of the toilet seat and near fixing ends of the toilet seat, holes formed on the backside of the toilet seat in the T-shaped ribs, and opposite elastic soft pads disposed on the backside away from the fixing ends;

a pedal integrally formed with a plane and two arced plates extending downward from two sides of the plane of the pedal, wherein horizontally arranged connecting holes are respectively formed at middle portions of the two arced plates;

an L-shaped link having a short rod portion, which may pass through a hole of the T-shaped rib for connecting and positioning and may be properly rotated, and a long rod portion, which is formed with one through hole or through holes near an end of the long rod portion, and may be swingably and selectively pivoted on an elliptic through hole on an end surface of the pedal, wherein a pin passes through the elliptic through hole and the through hole of the long rod portion for positioning; and a fixing plate having a plane and two side plates extending upward from two sides of the plane of the fixing plate, wherein the plane of the fixing plate is formed with a positioning hole through which a screw passes to fix and position the fixing plate to a ground, and vertically arranged fixing holes are formed on each of the two side plates, so that a positioning pin may pass through the corresponding one of each of the vertically arranged fixing holes and the corresponding one of each of the horizontal arranged connecting holes of the arced plates, whereby the pedal may swing about the fixing plate to move the link to control a lifting angle and a lifting distance of the toilet seat.

* * * * *